US007354037B2

(12) United States Patent
Olson et al.

(10) Patent No.: US 7,354,037 B2
(45) Date of Patent: Apr. 8, 2008

(54) STAPLER FOR A FINISHING DEVICE HAVING A VARIABLE START PULSE

(75) Inventors: Steven D. Olson, Rochester, NY (US); Raymond C. Bassett, Webster, NY (US); Charles A. Gerace, Cheektowaga, NY (US)

(73) Assignee: Xerox Corporation, Norwalk, CT (US)

( * ) Notice: Subject to any disclaimer, the term of this patent is extended or adjusted under 35 U.S.C. 154(b) by 16 days.

(21) Appl. No.: 11/452,621

(22) Filed: Jun. 14, 2006

(65) Prior Publication Data

US 2007/0289758 A1 Dec. 20, 2007

(51) Int. Cl.
*B42C 1/12* (2006.01)

(52) U.S. Cl. ..... 270/58.14; 227/2; 227/5; 227/111; 227/154; 270/52.18; 270/58.09; 271/293; 399/410

(58) Field of Classification Search ..... 227/2, 227/3, 5, 100, 102, 111, 99, 131, 154; 270/52.18, 270/58.09, 58.14, 58.08, 58.11; 271/293, 271/294; 399/14, 403, 408, 410, 382
See application file for complete search history.

(56) References Cited

U.S. PATENT DOCUMENTS 4,145,037 A * 3/1979 Mol ..... 270/58.18
4,361,373 A 11/1982 Gallusser et al.
4,421,264 A 12/1983 Arter et al.
4,864,350 A 9/1989 Ishiguro et al.
4,925,171 A 5/1990 Kramer et al.
5,161,724 A 11/1992 Radtke et al.
5,230,457 A 7/1993 Hiroi et al.
5,265,855 A * 11/1993 Kimura et al. ..... 270/58.15
5,354,042 A 10/1994 Coombs
5,481,353 A * 1/1996 Hicks et al. ..... 399/382
5,642,876 A * 7/1997 Ferrara et al. ..... 270/58.01
5,673,906 A * 10/1997 Furuya et al. ..... 270/58.14
5,823,529 A * 10/1998 Mandel et al. ..... 271/296
6,216,935 B1 4/2001 Oussani, Jr. et al.
6,325,368 B1 * 12/2001 Ikeda et al. ..... 271/3.03
6,386,080 B1 * 5/2002 Okamoto et al. ..... 83/73
6,671,491 B1 * 12/2003 Yamanaka et al. ..... 399/407
6,826,374 B2 * 11/2004 Kato et al. ..... 399/16

* cited by examiner

*Primary Examiner*—Scott A. Smith
(74) *Attorney, Agent, or Firm*—Luis M. Ortiz; Kermit D. Lopez; Ortiz & Lopez, PLLC

(57) ABSTRACT

A stapler is incorporated in a finishing device associated with a document creating apparatus. The stapler has a control circuit with a memory and is driven by a variably powered motor. An end user inputs the job parameter information at the control panel of the document creating apparatus for each different set of documents to be reproduced and stapled. In response thereto, the control panel sends a particular variable start pulse signal to the stapler control circuit. The control circuit senses the duration of the variable start pulse. Based upon the duration of the variable start pulse signal, the control circuit selects the motion control profile to be provided to the stapler motor from the various profiles stored in the memory of the control circuit.

9 Claims, 4 Drawing Sheets

STAPLER FOR A FINISHING DEVICE HAVING A VARIABLE START PULSE

BACKGROUND

An exemplary embodiment of this application relates to a stapler in a finishing device having a variable start pulse that communicates information on the sets of sheets or jobs to be stapled by the stapler. More particularly, the exemplary embodiment relates to a stapler having a variable start pulse for use in a finishing device that receives sets of sheets from an associated document creating apparatus, such as a copier or printer. An end user causes the variable pulse to be generated by inputting job parameter information at the control panel of the document creating apparatus. The duration of the variable start pulse is detected by the stapler and used to select a stapling cycle or algorithm from the various stapling cycles stored in the memory of the stapler that is suitable for both the thickness and media of the sets to be stapled.

As well known in the stapling industry, office copiers and printers may have sorters or finishing stations for sorting sheets received therefrom into collated sets and such collated sets may be automatically stapled in the sorter trays. The trays may also be shifted to a stapler as disclosed in U.S. Pat. No. 4,925,171. The sets may be partially removed from the trays, stapled and returned to the trays, or the sets may be transferred to a stapler as disclosed in U.S. Pat. No. 4,361,373. In all of these staplers, the stapler drives a staple into a set of sheets of some maximum number of sheets or thickness and the same stapler force is used even when a lesser number of sheets or a set of sheets having a lesser thickness is stapled.

As a result, the stapling force imparted is identical for stapling jobs whether the set to be stapled consists of many sheets or only a few sheets. Thus, the extra energy required to assure a thick set of sheets is successfully stapled results in a higher wear rate when only thin sets of sheets are stapled.

Many finishing devices and sheet stacking devices are known in the sheet handling equipment industry, involving collating or stacking of sheets into sets of sheets and finishing each set of sheets by stapling or binding prior to depositing the finished sets of sheets on a collection tray. U.S. Pat. No. 4,864,350 discloses that sheets entering a finishing device may be counted and the stapler disabled if the count is outside of a range of sheets, so that single sheets or sets of sheets exceeding the capacity of the stapler cannot be stapled.

U.S. Pat. No. 4,421,264 discloses a stapler for fastening variable thickness documents. A sensing device coupled to the stapler generates control pulses indicative of the relative motion between the head or hammer assembly and the clinching or anvil assembly of the stapler. A controller processes the pulses and generates control signals which vary the head assembly stroke and the force driving it. By measuring the distance that the head assembly travels from its home position until it contacts the stack of sheets to be fastened, the thickness of the stack can be determined. In addition, the force of the motor that drives the head assembly may be adjusted as a function of the stack thickness.

U.S. Pat. No. 5,161,724 discloses a stapling device for a stack of sheets having a movable staple head that presses an edge of the stack of sheets upwardly against an abutment. If a cam actuated arm having a lug is prevented from contacting an electrical contact on a fixed support above the stack of sheets, an electrical circuit is not completed and the stapled head is not actuated. If the thickness of the stack of sheets does not exceed the maximum thickness that may be stapled, the lug on the cam actuated arm will contact the electrical contact, thus completing the electrical circuit and enabling the staple head to staple the stack of sheets.

U.S. Pat. No. 5,230,457 discloses a sheet stapling device having a current sensor to detect the current load of the electric motor which drives the stapling device. The current sensor generates a signal during the stapling operation. A generated signal that is below a predetermined level indicates no staple is dispensed, and a signal that is above the predetermined level indicates a malfunction or jam or there are too many sheets to be stapled.

U.S. Pat. No. 5,354,042 discloses a sheet sorter having a stapler for stapling sets of sheets in the sorter bins. The stapler is actuated by an electric motor to which the applied power is varied depending upon the number of sheets in the sets and, thus, the thickness of the sets to be stapled. An optical sensor counts the sheets per tray. The purpose of the counting function is to enable the sorter microprocessor to control the power applied to the stapler motor. Since the force by which staples are applied to the sheets in the trays is a function of the level of electric power supplied to the stapler motor, the programmable power supply is capable of increasing or decreasing the applied motor power depending upon the number of sheets counted by the optical sensor.

U.S. Pat. No. 6,216,935 discloses a powered stapler having a solenoid as a driver for a spring biased armature with a stapler head at one end that confronts the stapler anvil. Activation of the solenoid overcomes the spring force and drives the stapler head towards the anvil. In the non-energized condition, the armature may be adjusted relative to the solenoid and the force exerted by the solenoid is varied as a function of the position of the armature with the solenoid. In one embodiment, a sensor mechanism is provided that shifts the position of the armature within the solenoid in accordance with the thickness of the sheets to be stapled.

SUMMARY

According to aspects illustrated herein, there is provided a stapler in a finishing device associated with a document creator, such as a copier or printer, that uses a variable start pulse to initiate and effect the stapling operation. The variable start pulse communicates information on the sets of sheets or jobs to be stapled and causes the power of the motor driving the stapler to vary according to that needed for media properties as well as page count or thickness.

In one aspect of the exemplary embodiment, there is provided a stapler that is incorporated in a finishing device associated with a document creator having a variable start pulse to communicate information on the set of documents to be stapled. The stapler has a control circuit and is driven by a variable powered motor. An end user inputs the job parameter information at the control panel of the document creator for each set of documents to be stapled, thereby generating a particular variable pulse signal. The stapler control circuit receives the variable start pulse signal and senses the duration thereof. Based upon the duration of the variable start pulse signal, the control circuit selects the power cycle to be provided to the stapler motor from the various power cycles stored in the memory of the control circuit.

In another aspect of the exemplary embodiment, there is provided a stapler having a variable start pulse for use in a finishing device that is associated with a document creating apparatus, comprising: a support on which a set of documents to be stapled may be accumulated; a driver assembly for inserting a staple into said set of documents supported on said support; a clincher movable from a position spaced from said set of documents on said support to a position in contact therewith; a reversible, variably powered motor for cycling said driver assembly from a home position toward said clincher to insert said staple into said set of documents and to return said driver assembly to said home position; a variable start pulse signal being generated at a control panel on said document creating apparatus by an end user in response to an inputting of job parameter information into said control panel; and a control circuit for receiving said variable start pulse signal and sensing the duration thereof, said control circuit selecting a different motion control profile for said motor for each cycle of said driver assembly based upon the sensed duration of said variable start pulse signal from a table of motion control profiles stored in a memory of said control circuit.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
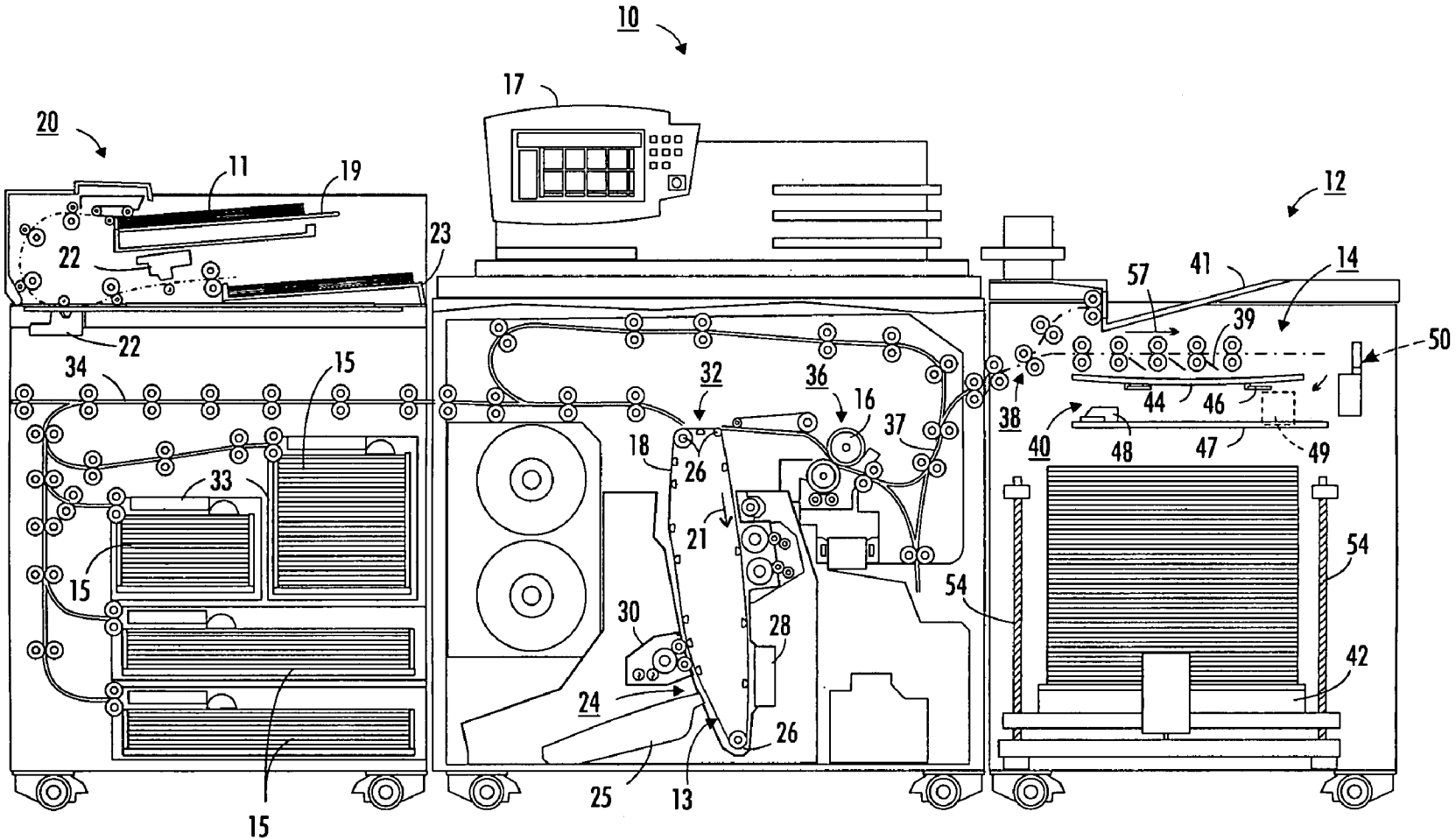
FIG. 1 is a schematic front elevation view of a finishing device incorporating the stapler of this application and shown associated with a high volume document creating apparatus, both shown in cross-section.

Referring to FIG. 1, there is shown a schematic front elevation view of the finishing device 12, incorporating the stapler 50 of this application. The finishing device is shown adjacent and operatively connected to a high-speed, high-volume document creating apparatus 10, such as, for example, a xerographic a copier or printer. A series of documents or sheets with image reproductions thereon are fed seriatim from the document creating apparatus to the finishing device for production of sets of these documents. As in all xerographic machines, including the one illustrated in FIG. 1, a light image of an original document or set of documents 11 to be reproduced is projected or scanned onto a uniformly charged surface 13 of a photoreceptor 18 to form an electrostatic latent image thereon. Thereafter, the latent image is developed with an oppositely charged developing material called toner (not shown) to form a toner image, corresponding to the latent image on the photoreceptor surface. The toner image is then electrostatically transferred to a final support material or paper sheet 15, to which it may be permanently fixed by a fusing device 16 to form a reproduced document.

In the illustrated apparatus 10 of FIG. 1, a set of original documents 11 to be copied is placed on tray 19 of an automatic document handler 20. The machine operator or end user enters the desired copying instructions through the control panel 17, such as, for example, number of copies or sets of copies, type and weight of media or sheets, and whether the media to be used is coated or not. Each sheet of each set of sheets in a job consisting of several sets may have different criteria or characteristics. For example, the sheets of each set of sheets may have a different weight with some sheets being coated while the remainder are uncoated or plain. The automatic document handler transports the documents 11 serially from the tray and past a scanning station 22 where each document is scanned thereby producing digital image signals corresponding to the informational areas on the original document. Once scanned, the documents 11 are deposited in an output tray 23. The image signals are projected upon the uniformly charged surface of the photoreceptor at an imaging station 24 by a raster output system 25 to form a latent electrostatic image of the scanned informational areas of the original document thereon as the photoreceptor is moved passed the imaging station.

The photoreceptor 18 is in the form of a flexible, endless belt having a photoconductive outer surface 13 and is mounted on a set of rollers 26. At least one of the rollers is driven to move the photoreceptor in the direction indicated by arrow 21 at a constant rate of speed about the rollers and past the various xerographic processing stations. Prior to entering the imaging station 24, the photoreceptor surface 13 is uniformly charged at a charging station 28. The exposure of the charged surface of the photoreceptor to the digital signals at the imaging station discharges the photoreceptor surface in the areas struck by the digital image signals. Thus, there remains on the photoreceptor surface a latent electrostatic image in image configuration corresponding to the informational areas on the original. As the photoreceptor continues its movement, the latent electrostatic image thereon passes through developing station 30 where oppositely charged toner is deposited on the latent electrostatic image to form a toner image.

The photoreceptor movement is continued transporting the toner image from the developer station to a transfer station 32. A sheet 15 is fed from a paper supply 33 to a sheet transport 34 for travel to the transfer station. The sheet is moved at a speed in synchronism with the moving photoreceptor and into aligned and registered contact with the toner image. Transfer of the toner image to the sheet is effected and the sheet with the toner image is stripped from the photoreceptor and conveyed to a fusing station 36 having fuser device 16 where the toner image is fused to permanently fix the toner image to the sheet. After the toner image is fixed to the sheet, the sheet is transported by sheet transporting mechanism 37 to a finishing station 12 where the sheets with the permanent images thereon may be compiled into sets of sheets and finished by being stapled by stapler 50.

Suitable drive means (not shown) for the document creating apparatus are arranged to drive the photoreceptor in timed relationship to the scanning of the original document and forming the latent electrostatic image on the photoreceptor, to effect development of the latent electrostatic image, to separate and feed sheets of paper, to transport same through the transfer station in time registration with the toner image, and to convey the sheet of paper with the toner image through the fusing station to fix the toner image thereto in a timed sequence to produce copies of the original documents.

The foregoing description is believed to be sufficient for the purposes of showing the general operation of a high-speed, high-volume document creating apparatus that is capable of producing 100 copies per minute. Thus, it is clear that such high speed, high volume copy producing machines require a finishing device capable of collating and stapling sets of documents varying in size from 2 to 100 sheets.

A typical finishing device 12 for support to a high speed, high volume copier or printer 10 may comprise a sheet transport assembly 38 with diverter gate baffles 39, a sheet guiding and buffering mechanism 14, a compiling and stapling station 40, and a collection tray 42 for storing finished sets of documents. The sheet transport assembly 38 receives and transports sheets 15 from the document creating apparatus 10 along a paper path indicated by arrow 57 to a selected and actuated one of the diverter gate baffles 39. The actuated diverter gate baffle, in cooperation with the drive rollers of the transport assembly 38, divert and deposit the sheet onto the guiding and buffering mechanism in accordance with well known procedure. The sheet guiding and buffering mechanism comprises two elongated retractable arms 44, each being retractable by two arm links 46, onto which sheets are deposited by the transport assembly. The arm surfaces have a slight concave curvature along their length to cause the sheet or sheets deposited thereon to conform to the curvature and create some added beam strength that will prevent the sheets from buckling and slipping between and through the arms prematurely.

Figure 2:
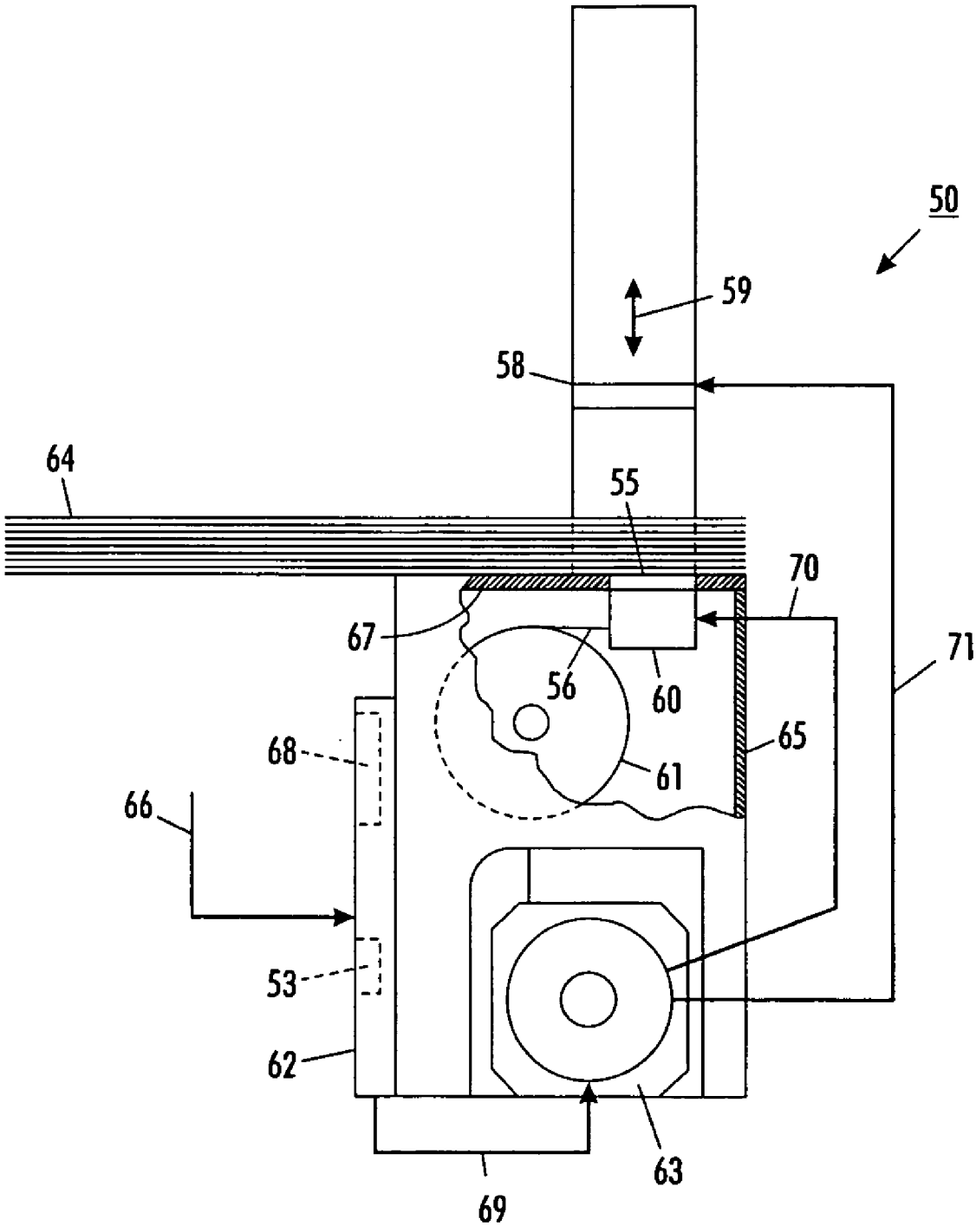
FIG. 2 is a schematic illustration of the stapler shown in FIG. 1 and depicted in a front elevation view with a portion partially sectioned.

As shown in FIG. 1, the finishing device 12 has a top output tray 41 for receipt of sheets from the transport assembly 38 not requiring a finishing operation. The compiling and stapling station 40 comprises two retractable platforms 47 with a trail edge tamper 48 and side tampers 49 (shown in dashed line). Referring also to FIG. 2, sheets are stacked and compiled into a set 64 on platforms 47 with one edge thereof positioned on the stapler support 67. Then each set of sheets is stapled by stapler 50 in response to a variable start pulse 66 (see FIG. 3) received from the control panel 17 of the document creating apparatus 10. An ejection device (not shown) at the compiling and stapling station 40 ejects each stapled set of sheets from the stapler 50. Simultaneously, two retractable platforms 47 are then retracted to allow the stapled set to be dropped onto vertically movable collection tray 42. In this embodiment, the collection tray is vertically movable by, for example, vertical screws 54 at each corner of the tray. A stack height sensor (not shown) may be used to control the movement of the tray, so that the top of the last stapled set of sheets thereon remains at substantially the same level.

Staplers should be able to staple a wide range of media thickness used to make up a set of documents, including coated media. In fact, stapling in a range of from 2 sheets to 100 or more sheets per set of documents is common for high volume document creating apparatus. Some staplers may vary the motor force to the stapler based upon the sensed height or counted number of sheets per set of sheets to be stapled. The motor force is then based upon the determination of either a small, medium or thick set of documents with the maximum motor power set for the thickest allowed set of documents and the power proportionally reduced for the sets with lesser number of sheets. However, if the individual weight of the media making up each of the sets of documents varies, then more or less motor power may be required. A set composed of thin sheets requires less motor power to staple than a same sized set of composed of thicker sheets. Also, it is known that coated sheets require more stapling force than plain sheets. Therefore, to assure a successful stapling operation, each category of small, medium and thick sets of sheets must be accomplished by a force required to staple not only the maximum number of sheets in each size category, but also the added force required if each of the sheets in the set were coated and of maximum weight. This extra energy used to assure stapling performance results in a higher wear rate on the stapler, as well as being energy inefficient.

In FIG. 2, a schematic illustration of stapler 50 of this application is shown. The stapler includes a driver assembly 60, a clincher 58, electric motor 63, and an electrical control circuit 62, all mounted in housing 65. In response to receipt of a variable start pulse 66 from the control panel of the document creating apparatus 10, the control circuit 62 selects a motion control profile corresponding to the duration of the variable start pulse from a lookup table stored in its memory 68 (shown in dashed line) and in accordance with the selected profile directs the motor 63 to move the clincher 58 into contact with the set of documents 64 on support 67 and actuates the driver assembly 60, so that a staple is driven into a set of documents 64 without intervention of an end user or operator. The support 67 is coupled to the housing 65 of the stapler 50 and supports a set of documents to be stapled. The clincher 58, once moved into contact with the set of documents on support 67, holds the set of documents in place on the support 67 while the driver assembly 60 inserts a staple therein. The clincher 58 has a pair of arms (not shown) that move towards each other and clinch the ends of the staple that has been driven into and through the set of documents. The configuration shown is such that the clincher 58 is disposed above the set of documents 64 on the stapler support 67 with a space between them. The spacing between the clincher 58 and the support 67 is sufficient to accommodate a set of documents to be stapled in the range of 2 to 100 sheets.

The driver assembly 60 is supplied with staples from a staple supply cassette 61. An opening in the cassette is aligned and contiguous with the driver assembly 60. The function of the cassette 61 is to store a ribbon 56 of individual staples that are removably attached together and to feed the staples to the driver assembly 60. The driver assembly 60 moves away from its home position below the stapler support 67 and contacts a staple on the free end of the ribbon of staples 56, shapes it into a U-shape having parallel legs pointing towards the support 67. Simultaneously, the driver assembly drives the staple through an opening 55 in the support 67 and the staple legs through the set of documents residing on support 67. Arms of clincher 58 bend the staple legs protruding through the set of documents towards each other to clinch and fasten the set of documents.

The electrical control circuit 62 includes a memory 68 (shown in dashed line) and is located on the housing 65 below stapler support 67. Various motion control profiles or algorithms are stored in a lookup table in memory 68, each having a power level for the motor 63. Each profile or algorithm causes the clincher 58 to move into contact with and clamp the set of documents on the support 67 and the driver assembly 60 to move from the home position located below the support 67 towards the clincher 58. Continued movement of the driver assembly drives a U-shaped staple through the specifically defined set of documents and simultaneously forms the next staple into a "U." The arms of the clincher 58 clinch the staple legs protruding through the set of documents. Then the clincher is returned to its spaced position above the support 67 and the driver assembly is returned to its home position. Each profile or algorithm has an empirically determined motor power or energy level required to successfully staple a defined set of documents based upon specific media parameters. Examples of media parameters are paper weight in grams per square meter (g/sm), whether coated or uncoated sheets are used, as well as for specific number of sheets.

An operator or end user inputs the job parameter information, as mentioned above, at the control panel 17 of the document creating apparatus 10. In response to the job parameter information inputted into the control panel, a microprocessor (not shown) in the document creating apparatus associated with the control panel generates a variable start pulse 66 and directs the variable start pulse to the control circuit 62. Each variable start pulse has a specific duration in milliseconds (ms) based upon the job parameter information. As soon as the complete set of documents on the stapler support 67 has been confirmed by any suitable sensing device (not shown), the control circuit responds to the variable start pulse and determines its duration. For either single sheets or collated sets of documents that are not to be stapled, a variable start pulse is not generated.

Each sheet of each set of documents of a job inputted into the control panel 17 by an end user is assigned a value. The values of each sheet for a given set of documents are summed into one total value for the set. Each different summed total value is assigned a variable start pulse having a specific unique duration that represents a specific motion control profile or algorithm that is stored in the memory of the control circuit of stapler 50. For example, a sheet having the weight of 75 g/sm is given the value of 75, plain sheets (not coated) are given a value of 1, and coated sheets are given a value of 2. For a set of 20 plain sheets having a weight of 75 g/sm, the total value is 75×1×20=1,500 and may be assigned, for example, a variable start pulse duration of 25 milliseconds (ms). For the same set of documents but having coated sheets, the total value is 75×2×20=3,000 and may be assigned, for example, a variable start pulse duration of 20 ms. The variable start pulse duration is not aligned to a set thickness. To the contrary, it is aligned to a motion control profile or algorithm stored in memory 68 of the stapler control circuit 62. Thus, a lower variable start pulse duration does not necessarily mean it represents a small or thin set of documents. It is the software designer that establishes what each variable start pulse duration represents and is to be matched to the appropriate motion control profile stored in the control circuit memory.

In another example, a 20-sheet set of documents may have sheets with different media weight with some sheets coated and the rest plain. In this case, 10 sheets are coated and have a weight of 75 g/sm, while the remaining 10 sheets have a weight of 55 g/sm and are plain or uncoated. Thus, the total value is (75×2×10)+(55×1×10)=2,050 and may be assigned a variable start pulse duration of 30 ms. A particular motion control profile would be stored in the memory 68 for a pulse of this duration.

Accordingly, each set of documents in each job entered in the control panel 17 of the document creating apparatus 10 may be different. Therefore, each set of documents in the job may have a different variable start pulse and a different motion control profile that directs the stapling operation by the stapler 50. Whether the number of sheets in each set varies, the weight of the sheets making up the set varies, or if some sheets are coated and some are not coated, a variable start pulse having a specific duration is generated for each different set. Since each variable start pulse duration represents a specific motion control profile, an energy efficient stapling operation is accomplished for each set of the job inputted by the end user.

Because some jobs have a number of identical sets of documents that require stapling, the control circuit 62 also includes a timer 53 that times the speed of the stapling operation carried out by the stapler. If the speed of stapling by the stapler is faster than an empirically determined, optimum time period, also stored in memory 68 for each profile, the control circuit 62 determines too much power was applied to the motor 63. The control circuit then reduces the motor power for the subsequent identical sets of documents to by stapled. Thus, the control circuit 62 compares the stapling speed with the optimum stapling speed for each particular motion control profile stored in memory 68 and determines whether the stapling speed is within acceptable limits of the optimum speed. When the speed limits have been exceeded, the control circuit adjusts the profile for the succeeding identical stapling operation. Accordingly, the motor power may be optimized for subsequent identical sets of documents. Again, it is the job parameter information input by the end user that provides the signal to the control circuit 62 that identifies identical sets of documents by a specific variable start pulse, referred to as a same set pulse. For example, a same set pulse having a duration of 9 ms would mean that the second set of documents in a job are identical to the first set in that particular job.

The stapler control circuit 62 senses the variable start pulse received thereby and determines its duration in milliseconds (ms). The stapler control circuit 62 compares the variable start pulse duration with the various motion control profiles or algorithms stored in a look up table in the memory 68 that are represented by predetermined time periods. One of the profiles stored is memory 68 is matched with the variable start pulse duration sensed by the control circuit. The matched profile is directed to the motor 63 by conductor 69. In response to the profile received by the motor, the motor powers the driver assembly and clincher by suitable gears or timing belt assembly represented by lines 70 and 71, respectively, to complete the stapling cycle. The motor force is thus optimized for stapling each set of documents based upon the job parameter information inputted by the end user.

Figure 3:
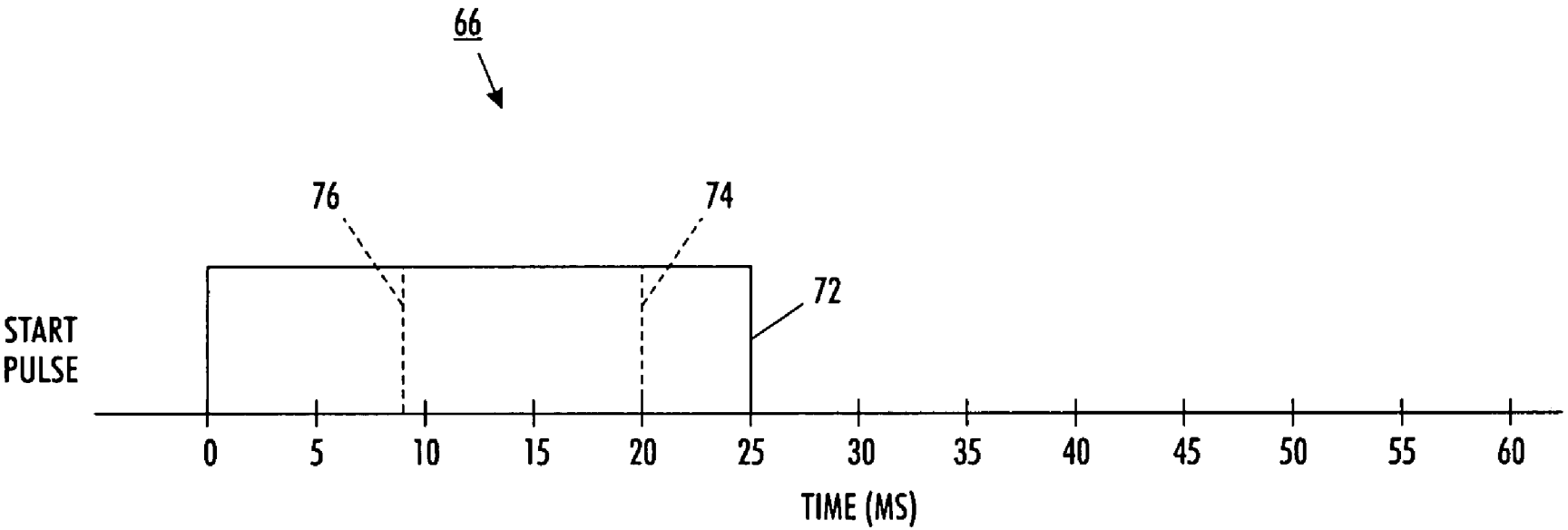
FIG. 3 is a graph of typical variable start pulses generated at the control panel of the document creating apparatus and sent to the stapler to initiate a stapling operation.

In FIG. 3, a variable start pulse 66 is shown. Each variable start pulse may have a different time duration. For example, variable start pulse 72 has a duration of 25 ms, variable start pulse 74 has a duration of 20 ms, and variable start pulse 76 has a duration of 9 ms. Each variable start pulse duration represents a specific motion control profile for the stapler and depending upon the ability of the control circuit to distinguish between pulse durations, quite a number of profiles or algorithms may be stored in the memory of the control circuit and, upon being matched by a particular variable start pulse duration sensed thereby, the matched profile is used to cycle the stapler through a stapling operation.

Figure 4:
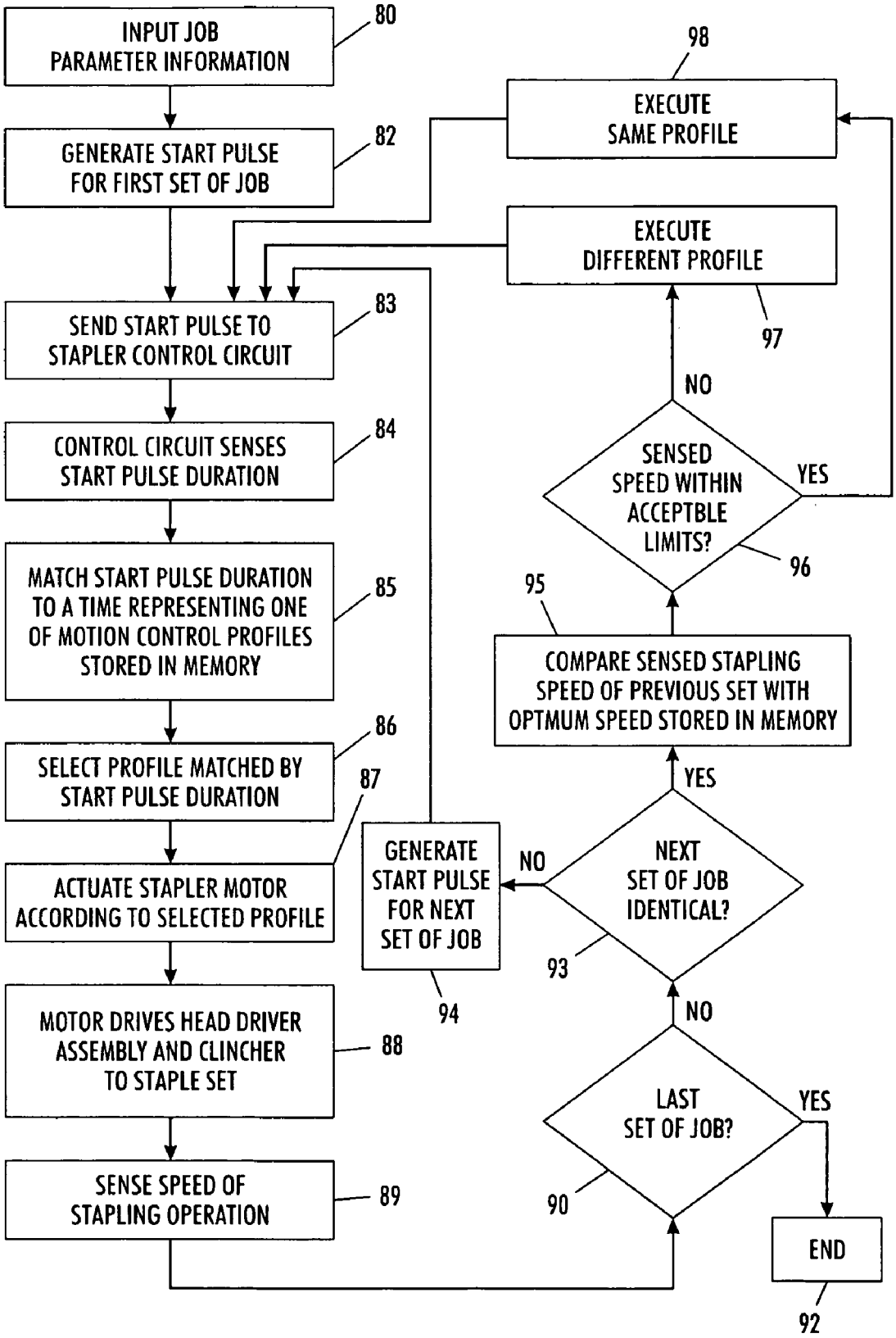
FIG. 4 is a flow chart illustrating the operation of the stapler shown in FIG. 2.

Referring to FIG. 4, a flow chart is shown illustrating the operation of stapler 50. The job parameter information is input into the control panel 17 of the document creating apparatus 10 by the end user or machine operator. Information on each sheet of each set of documents that make up the total job is entered at step 80. The microprocessor (not shown) that is associated with the control panel 17 generates a variable start pulse for the first set of documents of the job at step 82. At step 83, this variable start pulse is sent to the stapler control circuit 62. At step 84, the control circuit senses the variable start pulse and determines its duration. At step 85, the duration time of the variable start pulse is compared and matched with a time duration representing one of the motion control profiles or algorithms stored in memory 68. The profile matched to the duration of the variable start pulse is selected at step 86. Upon confirmation that the complete set of documents 64 has arrived on support 67 of the stapler, the stapler motor 63 is actuated in accordance with the selected profile at step 87. At step 88, the motor 63 moves the clincher 58 into contact with the set of documents residing on support 67 and drives the driver assembly 60 from a home position below support 67 towards the clincher 58 to staple the set of documents. The speed of the stapling operation is determined by timer 53 in the control circuit 62 at step 89.

After the set of documents has been stapled, the control circuit checks to see if this is the last set of documents in the current job to be stapled at step 90. If the last set of documents in the job has been stapled, the job is ended at step 92. Otherwise, the control circuit checks to see if the next set of documents in the job is identical with the previously stapled set at step 93. If the next set of documents to be stapled is not identical to the previously stapled set, a variable start pulse for the next set of documents is generated at step 94 and sent to the stapler control circuit at step 83.

If the next set of documents to be stapled is identical to the previously stapled set, the speed of the previous stapling operation is compared to the optimum stapling speed stored in memory 68 at step 95. At step 96, the control circuit 62 determines if the stapling speed is within acceptable limits of the optimum stapling speed. If the previous stapling speed is acceptable, the same profile or algorithm is executed at step 98 and sent to the control circuit at step 83. If the stapling speed of the previous identical set of documents is not within acceptable limits of the optimum stapling speed stored in memory, the profile or algorithm is modified to adjust the power to motor 63 at step 97.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of stapling by a stapler located in a finishing device operatively connected to a document creating apparatus, the stapler being actuated by a variable start pulse, comprising:

inputting media parameter information for each document of each set of documents in each job into a control panel of said document creating apparatus by an end user;

generating a variable start pulse having a predetermined duration of time by said control panel for a set of documents in said job in response to said media parameter information;

directing said variable start pulse to a control circuit of said stapler;

accumulating said set of documents produced by said document creating apparatus onto a support of said stapler;

detecting the duration of said variable start pulse by said control circuit;

providing various motion control profiles in a memory of said control circuit, each motion control profile being identified by a specific time duration of a variable start pulse;

selecting a motion control profile from said various motion control profiles stored in said memory of said control circuit that matches the predetermined time duration of said variable start pulse detected by said control circuit;

providing a reversible, variably powered motor for cycling a driver assembly of said stapler; and actuating said motor in response to said selected motion control profile to move said driver assembly through a cycle from a home position to staple said first set of documents on said support and return said driver assembly to said home position.

2. The method as claimed in claim 1, wherein the method further comprises:

providing a timer in said control circuit to sense the timing of each stapling operation; and storing optimum speeds in said memory for each motion control profile stored in said memory.

3. The method as claimed in claim 2, wherein the method further comprises:

determining if the next set of documents in said job is identical to said last stapled set of documents, when said stapled set of documents is not the last set of documents in said job; and generating a variable start pulse having a different predetermined duration of time by said control panel for the next set of documents in said job in response to said media parameter information, when said next set of documents is not identical to said first set of documents.

4. The method as claimed in claim 2, wherein the method further comprises:

sensing the speed of stapling of said set of documents;

comparing the sensed stapling speed of said set of documents with said optimum speeds stored in said memory; and determining if said sensed stapling speed is within acceptable limits of said optimum speed for the profile used by the stapler.

5. The method as claimed in claim 4, wherein the method further comprises:

executing and directing a same variable start pulse to said control circuit when both said next set of documents in said job is identical to said previously stapled set of documents and said speed of stapling of said previously stapled set of documents is within acceptable limits of said optimum speed for the profile used by the stapler.

6. The method as claimed in claim 4, wherein said method further comprises:

adjusting said variable start pulse of a subsequent set of documents to be stapled that is identical to said previously stapled set of documents and said stapling speed of said previously stapled set of documents is not within acceptable limits of said optimum stapling speed; and executing and directing said adjusted variable start pulse to said control circuit.

7. The method as claimed in claim 1, wherein the method further comprises:

determining if said stapled set of documents is the last set of documents to be stapled in said job; and ending said stapling method, if said stapled set of documents is the last set of documents in said job.

8. The method as claimed in claim 1, wherein the method further comprises:

providing a movable clincher spaced above said set of documents on said support; and moving said clincher into contact with said set of documents on said support to clamp said set of documents thereon when said motor is actuated to cycle said driver assembly.

9. The method as claimed in claim 8, wherein the method further comprises:

locating said driver assembly below said support;

forming a staple into a U-shape having a pair of legs; and driving said legs of said staple through an opening in said support and through said set of documents thereon by said driver assembly, so that distal ends of said staple legs protruding through said set of documents may be bent by said clincher to fasten said set of documents together.

* * * * *